US008919259B2

(12) United States Patent
Foege

(10) Patent No.: US 8,919,259 B2
(45) Date of Patent: Dec. 30, 2014

(54) FUEL SYSTEM FOR CONSIST HAVING DAUGHTER LOCOMOTIVE

(75) Inventor: Aaron Gamache Foege, Westmont, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 105 days.

(21) Appl. No.: 13/563,242

(22) Filed: Jul. 31, 2012

(65) Prior Publication Data

US 2014/0034151 A1 Feb. 6, 2014

(51) Int. Cl.
*B61C 5/00* (2006.01)

(52) U.S. Cl.
USPC ..... 105/26.05

(58) Field of Classification Search
CPC ..... B61C 5/00
USPC ..... 105/26.05, 61.5
See application file for complete search history.

(56) References Cited

U.S. PATENT DOCUMENTS

| | | | |
|---|---|---|---|
| 308,948 | A | 12/1884 | Bruce |
| 331,716 | A | 12/1885 | Katz |
| 338,028 | A | 3/1886 | Bower |
| 3,352,294 | A | 11/1967 | Biller et al. |
| 4,137,006 | A | 1/1979 | Becker |
| 4,551,065 | A | 11/1985 | Becker |
| 4,630,572 | A | 12/1986 | Evans |
| 4,646,701 | A | 3/1987 | Fukumoto |
| 5,129,328 | A | 7/1992 | Donnelly |
| 5,269,225 | A | 12/1993 | Bosshart et al. |
| 5,375,580 | A | 12/1994 | Stolz et al. |
| 5,544,483 | A | 8/1996 | Heuer |
| 5,567,105 | A | 10/1996 | Williams |
| 5,609,141 | A | 3/1997 | Matsuoka et al. |
| 5,692,458 | A | 12/1997 | Green |
| 5,887,567 | A | 3/1999 | White et al. |
| 6,408,766 | B1 | 6/2002 | McLaughlin et al. |
| 6,460,517 | B1 | 10/2002 | Dauer |
| 6,506,018 | B1 | 1/2003 | Brennan |
| 6,698,211 | B2 | 3/2004 | Gustafson |
| 6,898,940 | B2 | 5/2005 | Gram et al. |

(Continued)

FOREIGN PATENT DOCUMENTS

| | | |
|---|---|---|
| CH | 1 261 237 | 3/1969 |
| DE | 102009042256 | 4/2011 |

(Continued)

OTHER PUBLICATIONS

Foege, "Consist Having Self-Powered Tender Car", U.S. Appl. No. 13/563,154 dated Jul. 31, 2012.

(Continued)

*Primary Examiner* — Zachary Kuhfuss
(74) *Attorney, Agent, or Firm* — Finnegan, Henderson, Farabow, Garrett & Dunner LLP

(57) ABSTRACT

The disclosure is directed to a fuel system for a consist. The fuel system may have a tank located on a tender car of the consist and configured to hold a supply of liquefied gaseous fuel. The fuel system may also have an accumulator located on a daughter locomotive of the consist and configured to hold a supply of gaseous fuel. The fuel system may further have at least one conduit fluidly connecting the tank to the accumulator and the accumulator to a first engine on a lead locomotive of the consist.

17 Claims, 2 Drawing Sheets

(56) References Cited

U.S. PATENT DOCUMENTS

| | | | | |
|---|---|---|---|---|
| 6,907,735 | B2 | 6/2005 | Wolff et al. | |
| 7,304,445 | B2 | 12/2007 | Donnelly | |
| 7,308,889 | B2 | 12/2007 | Post et al. | |
| 7,373,931 | B2 | 5/2008 | Lennox et al. | |
| 7,430,967 | B2 | 10/2008 | Kumar | |
| 7,448,328 | B2 | 11/2008 | Kumar | |
| 7,631,635 | B2 | 12/2009 | Hochstein et al. | |
| 7,689,341 | B2 | 3/2010 | Miller | |
| 8,056,540 | B2 | 11/2011 | Debastos et al. | |
| 8,079,437 | B2 | 12/2011 | Rosman | |
| 8,112,191 | B2 | 2/2012 | Kumar et al. | |
| 2003/0233959 | A1 * | 12/2003 | Kumar | 105/26.05 |
| 2004/0149254 | A1 | 8/2004 | Piock | |
| 2005/0279242 | A1 | 12/2005 | Maier et al. | |
| 2008/0000381 | A1 | 1/2008 | Bartley et al. | |
| 2008/0083576 | A1 | 4/2008 | Read | |
| 2008/0121136 | A1 | 5/2008 | Mari et al. | |
| 2008/0302093 | A1 | 12/2008 | Montgomery et al. | |
| 2009/0187291 | A1 | 7/2009 | Daum et al. | |
| 2009/0234521 | A1 | 9/2009 | Kumar et al. | |
| 2010/0019103 | A1 | 1/2010 | Kane et al. | |
| 2010/0070117 | A1 | 3/2010 | Siffert | |
| 2010/0114404 | A1 | 5/2010 | Donnelly | |
| 2010/0175579 | A1 | 7/2010 | Read | |
| 2010/0186619 | A1 | 7/2010 | Kumar | |
| 2011/0061364 | A1 | 3/2011 | Raman | |
| 2011/0067390 | A1 | 3/2011 | Cook | |
| 2011/0162903 | A1 | 7/2011 | Stragier | |
| 2011/0203480 | A1 | 8/2011 | Donnelly | |
| 2011/0257869 | A1 | 10/2011 | Kumar et al. | |
| 2012/0085260 | A1 | 4/2012 | Nichini et al. | |

FOREIGN PATENT DOCUMENTS

| | | |
|---|---|---|
| EP | 0 069 717 | 12/1983 |
| EP | 2 154 044 A2 | 2/2010 |
| EP | 2 154 044 B1 | 1/2012 |
| JP | 56 118533 | 9/1981 |
| JP | 6 033 784 | 2/1994 |
| JP | 2000 136756 | 5/2000 |
| JP | 2007 113442 | 5/2007 |
| JP | 2008 201890 | 9/2008 |
| JP | 2010 023776 | 2/2010 |
| RU | 2009142173 | 5/2011 |
| WO | WO 2008/025158 | 3/2008 |
| WO | WO 2009/021262 | 2/2009 |

OTHER PUBLICATIONS

Foege, "Consist Having Self-Propelled Tender Car", U.S. Appl. No. 13/563,114 dated Jul. 31, 2012.

Foege, "Energy Recovery System for a Mobile Machine", U.S. Appl. No. 13/563,414 dated Jul. 31, 2012.

Foege et al, "Energy Recovery System for a Mobile Machine", U.S. Appl. No. 13/562,808 dated Jul. 31, 2012.

Foege et al., "Fuel Distribution System for Multi-Locomotive Consist", U.S. Appl No. 13/563,220 dated Jul. 31, 2012.

Coldren et al., "Consist Power System Having Auxiliary Load Management", U.S. Appl. No. 61/677,770 dated Jul. 31, 2012.

* cited by examiner

FUEL SYSTEM FOR CONSIST HAVING DAUGHTER LOCOMOTIVE

TECHNICAL FIELD

The present disclosure relates generally to a fuel system and, more particularly, to a fuel system for a consist having a daughter locomotive.

BACKGROUND

Natural gas has been used as fuel for internal combustion engines in consist locomotives. Because natural gas has a lower volumetric energy density than traditional fuels, such as diesel and gasoline, the natural gas used by the locomotives is generally only practical to store in a liquefied state ("LNG"). At atmospheric pressures, the natural gas must be chilled to below about −160° C. to remain in liquid form. Consists having LNG-fueled locomotives store the LNG in insulated tank cars (a.k.a., tender cars) that are towed by the locomotive. An exemplary consist having an LNG-fueled locomotive coupled with a dedicated tender car is disclosed in U.S. Pat. No. 6,408,766 of McLaughlin that issued on Jun. 25, 2002.

In some consist configurations, multiple locomotive are used to tow the remaining cars of the consist. For example, two or more locomotives can be coupled to each other at the front of the consist. These locomotives can be controlled to operate in tandem to pull the consist, thereby increasing the total number of cars that can be assembled within the consist.

Although the conventional method of coupling a dedicated tender car to a single locomotive helps to ensure an adequate supply of fuel for most travel routes, it can also be cumbersome and expensive, while also decreasing an efficiency of the consist. In particular, when multiple locomotives are required to pull a consist, the extra tender cars (one per locomotive) increase component cost, operating cost, and maintenance cost, and operating complexity of the consist. In addition, the extra tender cars increase an overall weight of the consist and a required capacity and fuel consumption of the locomotives.

Similarly, the conventional method of utilizing multiple locomotives within a single consist can be expensive and decrease an efficiency of the consist. In particular, each locomotive includes a cabin having controls used to regulate operation of the locomotive. When multiple locomotives are coupled together within a single consist, only one of the cabins is utilized for control purposes, and the remaining cabins remain vacant. This inclusion of expensive and unnecessary equipment within the consist further increases the weight of the consist.

The consist and fuel system of the present disclosure solves one or more of the problems set forth above and/or other problems with existing technologies.

SUMMARY

In one aspect, the disclosure is directed to a fuel system for a consist. The fuel system may include a tank located on a tender car of the consist and configured to hold a supply of liquefied gaseous fuel. The fuel system may also include an accumulator located on a daughter locomotive of the consist and configured to hold a supply of gaseous fuel. The fuel system may further include at least one conduit fluidly connecting the tank to the accumulator and the accumulator to a first engine on a lead locomotive of the consist.

In another aspect, the disclosure is directed to a method of fueling a consist. The method may include pumping fuel from a tank located on a tender car of the consist to an accumulator on a daughter locomotive within the consist. The method may further include distributing the fuel from the accumulator to a first engine in a lead locomotive of the consist.

DETAILED DESCRIPTION

Figure 1:
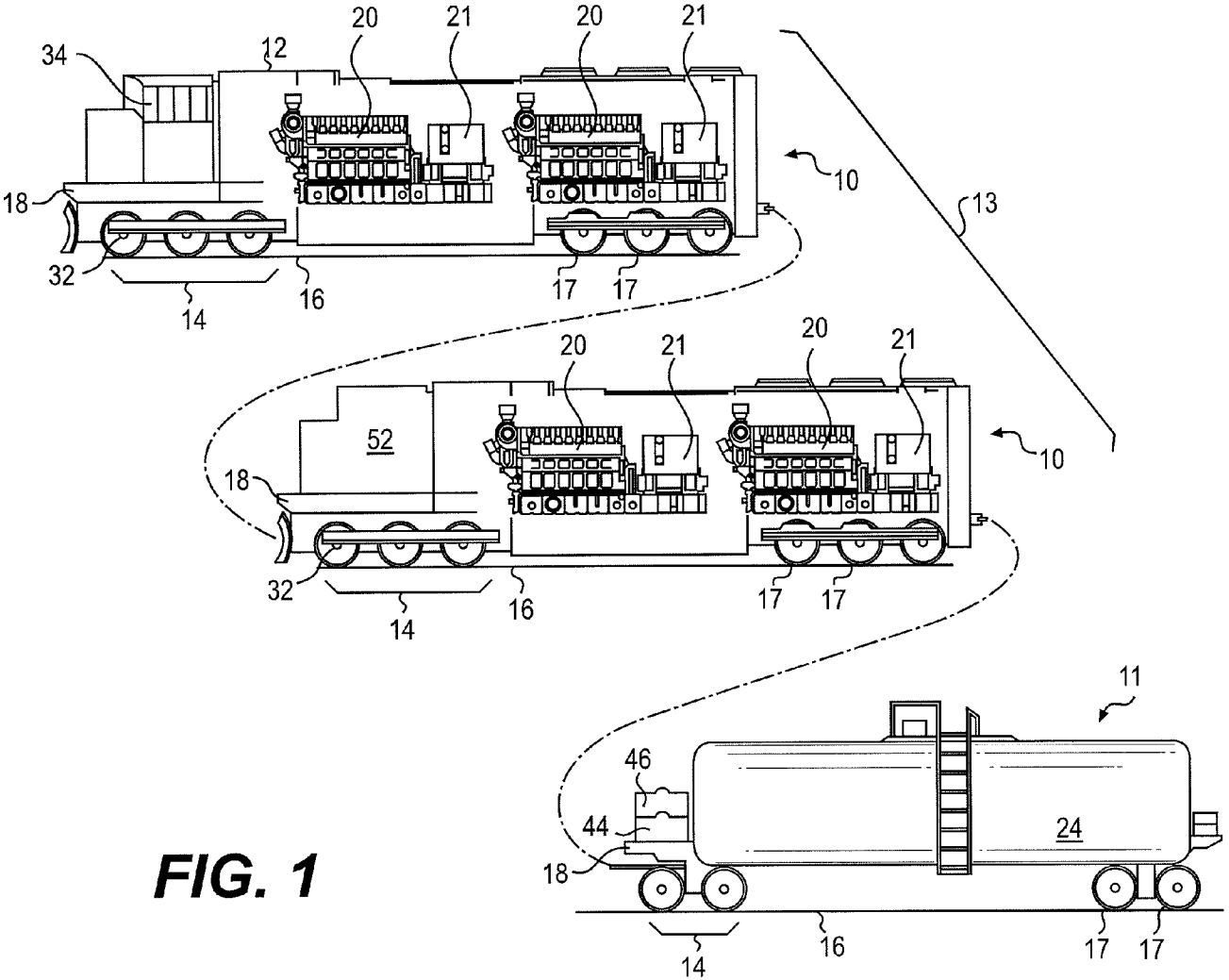
FIG. 1 is a pictorial illustration of an exemplary disclosed consist.

FIG. 1 illustrates an exemplary disclosed consist 13 having a lead locomotive 10, a daughter locomotive 15 connected to lead locomotive 10, and a tender car 11 connected behind daughter locomotive 15. In some embodiments, additional cars may be included within consist 13 and towed by lead and daughter locomotives 10, 15, for example, a passenger car (not shown), a cargo container car (not shown), or another type of car. It should be noted that, while a particular order of cars in consist 13 is shown in FIG. 1 and described above, a different order may be implemented as desired. For example, tender car 11 could be situated between lead and daughter locomotives 10, 15.

Lead locomotive 10 may include a car body 12 supported at opposing ends by a plurality of trucks 14 (e.g., two trucks 14). Each truck 14 may be configured to engage a track 16 via a plurality of wheels 17, and support a frame 18 of car body 12. Any number of engines 20 may be mounted to frame 18 and configured to produce electricity that drives wheels 17 included within each truck 14. In the exemplary embodiment shown in FIG. 1, locomotive 10 includes two engines 20.

Engine 20 may be a large engine, for example an engine having sixteen cylinders and a rated power output of about 4,000 brake horsepower (bhp). Engine 20 may be configured to combust a gaseous fuel, such as natural gas, and generate a mechanical output that drives a generator 21 to produce electric power. The electric power from generator 21 may be used to propel locomotive 10 via one or more traction motors 32 associated with wheels 17 and, in some instances, directed to one or more auxiliary loads of consist 13 (e.g., lights, heaters, refrigeration devices, air conditioners, fans, etc.). It should be noted that engine 20 may have a different number of cylinders, a different rated power output, and/or be capable of combusting another type of fuel, if desired.

Generator 21 may be an induction generator, a permanent-magnet generator, a synchronous generator, or a switched-reluctance. In one embodiment, generator 21 may include multiple pairings of poles (not shown), each pairing having three phases arranged on a circumference of a stator (not shown) to produce an alternating current.

Traction motors 32, in addition to providing the propelling force of consist 13 when supplied with electric power, may also function to slow locomotive 10. This process is known in the art as dynamic braking. When a traction motor 32 is not needed to provide motivating force, it can be reconfigured to operate as a generator. As such, traction motors 32 may convert the kinetic energy of consist 13 into electric power, which has the effect of slowing consist 13. The electric power generated during dynamic braking is typically transferred to one or more resistance grids mounted on car body 12. At the resistance grids, the electric power generated during dynamic braking is converted to heat and dissipated into the atmosphere. Alternatively or additionally, electric power generated from dynamic braking may be routed to an energy storage system (not shown) and used to selectively provide supplemental power to traction motors 32.

Lead locomotive 10 may also include a cabin 34 supported by frame 18. Cabin 34 may be an onboard location from which an operator observes performance of locomotive 10 and consist 13, and provides instructions for controlling engine 20, generator 21, motors 32, brakes (not shown), and other components of consist 13. In the disclosed embodiment, cabin 34 is a substantially enclosed structure located at a leading end of locomotive 10. Cabin 34 may include one or more interface devices (not shown) located proximate an operator seat (not shown) that facilitate the manual control of consist 13.

For the purposes of this disclosure, a daughter locomotive may be considered to be a self-powered mobile train car having the same general components as a lead locomotive, except for the operator cabin. For example, daughter locomotive 15 in the exemplary embodiment includes car body 12, trucks 14, wheels 17, frame 18, engine(s) 20, generator(s) 21, and traction motors 32. It is contemplated that these components of daughter locomotive 15 may be identical to the corresponding components of lead locomotive 10 or, alternatively, have a different configuration, as desired. For example, the engines 10 of daughter locomotive 15 may have a reduced output as compared to the engines 20 of lead locomotive 10. Similarly, the traction motors 32 of daughter locomotive 15 could have a greater or lesser torque and/or speed capacity compared to the traction motors of lead locomotive 10.

In contrast to lead locomotive 10, daughter locomotive 20 may not be provided with a cabin 34. That is, in the space normally occupied by cabin 34, daughter locomotive 15 may instead be configured to support one or more fuel accumulators 52. The design and function of fuel accumulator 52 will be described in more detail below with reference to FIG. 2.

Similar to both of lead and daughter locomotives 10, 15, tender car 11 may also be equipped with trucks 14, wheels 17, and frame 18. It is contemplated that these components of tender car 11 may be identical to the corresponding components of lead and daughter locomotives 10, 15 or, alternatively, have a different configuration, as desired. Tender car 11 may also include a fuel tank 24 configured to hold a supply of liquefied natural gas (LNG) or another liquefied gaseous fuel. In the disclosed embodiment, a single tank 24 is shown, although multi-tank configurations are also possible. Tank 24 may be an insulated, single or multi-walled tank configured to store the liquefied fuel at low temperatures, such as below about −160° C. Tanks 24 may be integral with frame 18 of tender car 11.

Figure 2:
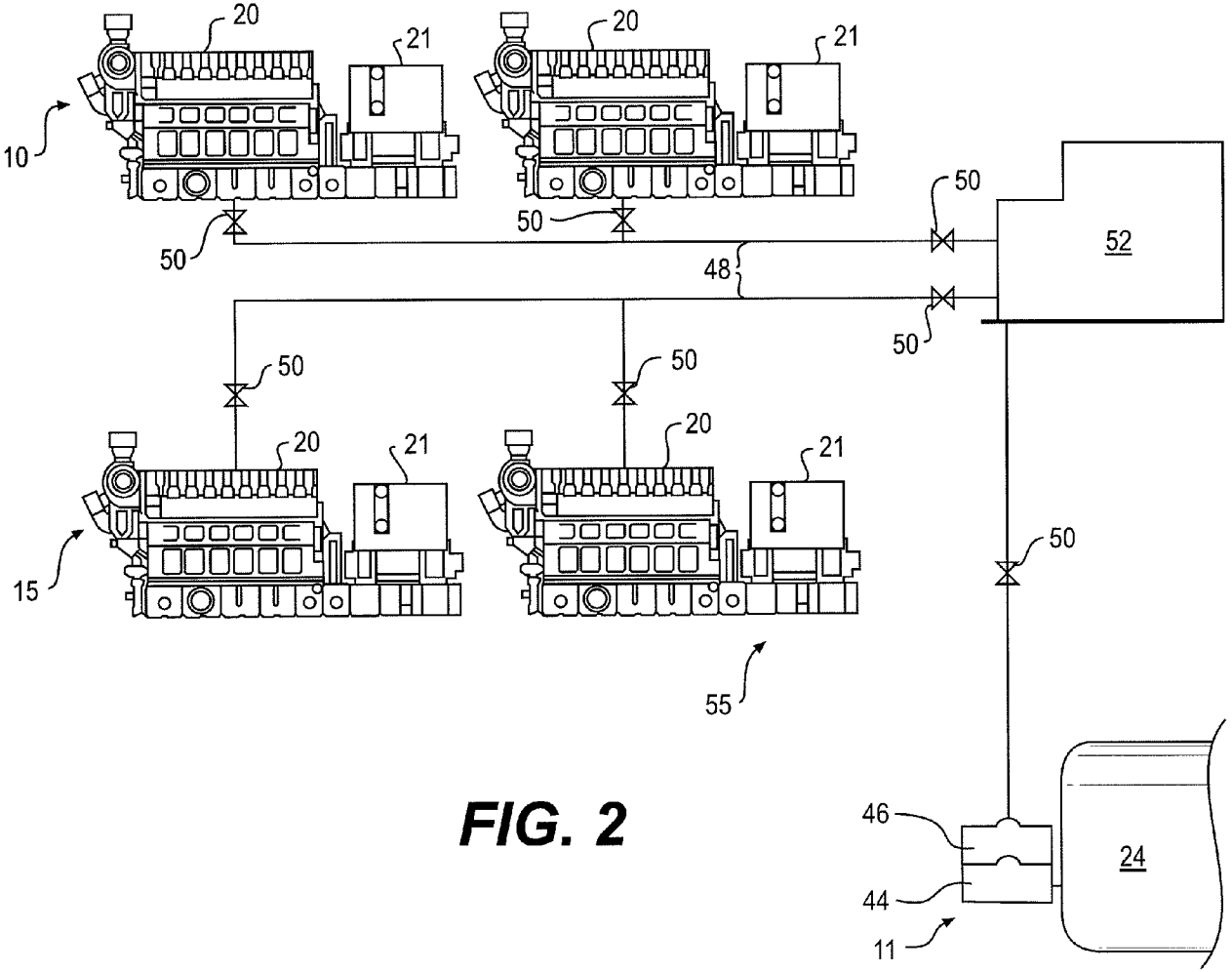
FIG. 2 is a diagrammatic illustration of an exemplary disclosed fuel system that may be used in conjunction with the consist of FIG. 1.

As shown in FIG. 2, a fuel system 55 may cooperate with tank 24 and accumulator 52 supply fuel to engines 20 of lead and daughter locomotives 10, 15. Fuel system 55 may include, among other things, one or more fuel pumps 44, one or more heat exchangers 46, one or more conduits 48, and one or more valves 50 that condition, pressurize, regulate or otherwise transport low-temperature liquefied and gaseous fuel, as is known in the art.

Pumps 44 may each be situated near or within tank 24, and embody, for example, cryogenic pumps, piston pumps, centrifugal pumps, or any other pumps that are known in the industry. Pumps 44 may be powered by electricity from generators 21 of lead and/or daughter locomotives 10, 15. Alternatively, pumps 44 may be powered by a power source (e.g., an auxiliary power unit, a storage device, etc.) located onboard tender car 11, if desired. Pumps 44 may pressurize the liquid fuel to an operating pressure of about 5,000 psi, and push the liquid fuel through heat exchangers 46 via conduits 48.

Heat exchangers 46 may also have components situated near or within tank 24. Heat exchangers 46 may embody, for example, air-to-air, liquid-to-air, or liquid-to-liquid type heat exchangers that are configured to impart heat to the liquefied fuel as it passes through heat exchangers 46. The amount of heat imparted to the liquefied fuel may be sufficient to vaporize the fuel. Upon vaporization, the fuel may be transported via conduits 48 to, and stored at, accumulator 52. In some embodiments, a valve 50 may be disposed between heat exchangers 46 and accumulator 52 to regulate the flow of fuel therebetween.

Accumulator 52 may be a pressure vessel filled with a compressible operating gas that is configured to store pressurized gaseous fuel for future use by engines 20. The operating gas may include, for example, nitrogen, argon, helium, or another appropriate compressible gas. As gaseous fuel in communication with accumulator 52 exceeds a predetermined pressure accumulator 52, the gaseous fuel may flow into accumulator 52. Because the operating gas therein is compressible, it may act like a spring and compress as the fuel flows into accumulator 52. When the pressure of the fluid within conduit 48 drops below the predetermined pressure accumulator 52, the compressed operating gas may expand and urge the fuel from within accumulator 52 toward engines 20. It is contemplated that accumulator 52 may alternatively embody a membrane/spring-biased or bladder type of accumulator, if desired One or more additional control valves 50 may be configured to selectively allow fluid communication between accumulator 50 and any one or more of engines 20. When control valve 50 is open, it may allow gaseous fuel to escape accumulator 52 and flow to the corresponding engine(s) 20. Control valve 50 may include a spring-loaded mechanism (not shown) that opens at a predetermined pressure to avoid overpressurization of accumulator 52. Additionally or alternatively, control valve 50 may each include one or more controllable actuators, such as one or more electric solenoids that are operable to open a flow path when actuated.

INDUSTRIAL APPLICABILITY

The disclosed fuel system may be applicable to any consist 13 utilizing a low-temperature liquefied fuel. The disclosed fuel system may reduce the difficult and expense of supplying fuel to multiple locomotives within a single consist by utilizing a common tender car. In addition, by utilizing a daughter locomotive together with a lead locomotive, instead of two conventional locomotives, a cost and weight of the consist may be reduced. Finally, by using the otherwise wasted cabin space on the daughter locomotive to house fuel system components, further savings may be realized.

It will be apparent to those skilled in the art that various modifications and variations can be made to the disclosed fuel system without departing from the scope of the disclosure. Other embodiments of the tender car will be apparent to those skilled in the art from consideration of the specification and practice of the fuel system disclosed herein. It is intended that the specification and examples be considered as exemplary only, with a true scope of the disclosure being indicated by the following claims and their equivalents.

What is claimed is:

1. A fuel system for a consist, comprising:

a tank located on a tender car of the consist and configured to hold a supply of liquefied gaseous fuel;

an accumulator located on a daughter locomotive of the consist and configured to hold a supply of gaseous fuel, wherein the accumulator is located on the daughter locomotive in a position corresponding to a cabin on a lead locomotive of the consist; and at least one conduit fluidly connecting the tank to the accumulator and the accumulator to a first engine on the lead locomotive.

2. The fuel system of claim 1, wherein the at least one conduit further fluidly connects the accumulator to a second engine on the daughter locomotive.

3. The fuel system of claim 2, further including at least one control valve configured to regulate fuel flow between the tank and the accumulator and between the accumulator and the first and second engines.

4. The fuel system of claim 3, wherein the first and second engines are substantially identical.

5. The fuel system of claim 3, further including at least one pump configured to move liquefied gaseous fuel from the tank toward the accumulator.

6. The fuel system of claim 5, further including at least one heat exchanger configured to vaporize the liquefied gaseous fuel from the pump.

7. The fuel system of claim 6, wherein the at least one pump and at least one heat exchanger are both located onboard the tender car.

8. The fuel system of claim 1, wherein fuel from the tank is pumped through the daughter locomotive to the lead locomotive.

9. A method of fueling a consist, comprising:

pumping fuel from a tank located on a tender car of the consist to an accumulator on a daughter locomotive within the consist, wherein the accumulator is located on the daughter locomotive in a position corresponding to a cabin on a lead locomotive of the consist; and distributing the fuel from the accumulator to a first engine in the lead locomotive of the consist.

10. The method of claim 9, further including distributing the fuel from the accumulator to a second engine on the daughter locomotive.

11. The method of claim 10, further including moving at least one control valve configured to regulate fuel flow between the tank and the accumulator and between the accumulator and the first and second engines.

12. The method of claim 11, wherein the fuel in the tank is a liquefied gaseous fuel.

13. The method of claim 12, further including vaporizing the liquefied gaseous fuel before directing the fuel to the accumulator.

14. The method of claim 12, wherein pumping and vaporizing occur onboard the tender car.

15. A consist, comprising:

a lead locomotive having at least a first engine configured to power the consist;

a daughter locomotive coupled to the lead locomotive and having at least a second engine configured to power the consist;

a tender car coupled to the daughter locomotive;

a tank located on the tender car and configured to hold a supply of liquefied gaseous fuel;

an accumulator located on the daughter locomotive in a position corresponding to a cabin on the lead locomotive;

a pump located on the tender car and configured to pump fuel from the tank;

a heat exchanger located on the tender car and configured to vaporize the fuel; and at least one conduit fluidly connecting the tank to the accumulator and the accumulator to the at least a first and at least a second engines on the lead locomotive and on the daughter locomotive.

16. The consist of claim 15, further including at least one control valve configured to regulate fuel flow between the tank and the accumulator and between the accumulator and the at least a first and second engines.

17. The consist of claim 15, wherein the first and second engines are substantially identical.

* * * * *